US010864620B2

(12) United States Patent
Ratliff

(10) Patent No.: US 10,864,620 B2
(45) Date of Patent: Dec. 15, 2020

(54) TOOL FOR INSTALLING AN INTERIOR TRUNK HANDLE OF A VEHICLE OR THE LIKE

(71) Applicant: Volvo Car Corporation, Gothenburg (SE)

(72) Inventor: Dana Ratliff, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 140 days.

(21) Appl. No.: 16/171,854

(22) Filed: Oct. 26, 2018

(65) Prior Publication Data

US 2020/0130154 A1 Apr. 30, 2020

(51) Int. Cl.

| | |
|---|---|
| ***B25B 27/14*** | (2006.01) |
| ***E05B 85/12*** | (2014.01) |
| ***E05B 79/06*** | (2014.01) |
| ***B25B 27/00*** | (2006.01) |

(52) U.S. Cl.

CPC ..... *B25B 27/0035* (2013.01); *B25B 27/14* (2013.01); *E05B 79/06* (2013.01); *E05B 85/12* (2013.01)

(58) Field of Classification Search

CPC ..... B25B 27/00; B25B 27/02; B25B 27/14; B25B 27/16; B25B 33/00; Y10T 29/537; Y10T 29/53909; Y10T 29/53943; E05B 79/06; E05B 85/12

See application file for complete search history.

(56) References Cited

U.S. PATENT DOCUMENTS

| | | | | |
|---|---|---|---|---|
| 5,075,945 | A * | 12/1991 | Krzecki | B25B 27/0028 29/235 |
| 6,340,189 | B1 * | 1/2002 | Pordy | B60N 3/023 16/110.1 |
| 9,085,073 | B2 * | 7/2015 | Hossack | B25C 3/008 |
| 9,327,392 | B2 * | 5/2016 | Reyna | B25B 27/14 |
| 9,360,039 | B2 * | 6/2016 | Endt | B23K 31/02 |

* cited by examiner

*Primary Examiner* — Tyrone V Hall, Jr.
*Assistant Examiner* — Makena S Markman
(74) *Attorney, Agent, or Firm* — Clements Bernard Walker; Christopher L. Bernard

(57) ABSTRACT

The present disclosure provides a tool for holding a recessed handle structure to be installed into a hole manufactured into the interior or bottom surface of a trunk door, providing required rotational leverage, and applying required linear pressure to locking tabs of the recessed handle structure as it is being installed into the interior or bottom surface of the trunk door, thereby securing the recessed handle structure within the hole manufactured into the interior or bottom surface of the trunk door. The use of this tool effectively saves time and protects the installer's fingers, hands, and the like.

20 Claims, 4 Drawing Sheets

TOOL FOR INSTALLING AN INTERIOR TRUNK HANDLE OF A VEHICLE OR THE LIKE

FIELD OF THE DISCLOSURE

The present disclosure relates generally to the automotive manufacturing field. More specifically, the present invention relates to a tool for installing an interior trunk handle of a vehicle or the like. The tool securely holds the interior trunk handle, provides required rotational leverage, and applies required linear pressure to locking tabs of the interior trunk handle as it is being installed into an interior or bottom surface of a trunk door. Such operation is typically performed manually, which can be time consuming, difficult, and cause injury to an installer's fingers, hands, and the like.

BACKGROUND OF THE DISCLOSURE

The trunk doors of many vehicles, both sedans and sport utility vehicles (SUVs), incorporate a recessed handle structure installed into the interior or bottom surface thereof. Typically, this recessed handle structure has a shape that generally conforms to a user's hand or fingers, forming a cup-like structure. The recessed handle structure makes it easier for the user to grasp and hold, push, or pull the trunk door as it is being opened or closed manually. During manufacture, the recessed handle structure is usually installed into the interior or bottom surface of the trunk door with the trunk door in a partially or fully open configuration. The recessed handle structure has a front or bottom side that includes one or more tab structures that are disposed beneath the interior or bottom surface of the trunk door, such that the front or bottom side of a lip structure disposed around the user-facing side of the recessed handle structure sits substantially in contact and flush with the interior or bottom surface of the trunk door. The hand or finger-receiving portion of the recessed handle structure sits within a hole manufactured into the interior or bottom surface of the trunk door. The recessed handle structure is then rotated and pressed into position, such that locking tabs disposed on the rear or top side of the recessed handle structure are compressed into the hole manufactured into the interior or bottom surface of the trunk door and snap back beneath the interior or bottom surface of the trunk door, thereby securing the recessed handle structure within the hole manufactured into the interior or bottom surface of the trunk door. In this position, the entire lip structure disposed around the user-facing side of the recessed handle structure sits substantially in contact and flush with the interior or bottom surface of the trunk door.

This rotating and pressing process is typically performed manually by the installer, using only his or her fingers and hands, which can be time consuming, difficult, and cause injury to the installer's fingers and hands. The process is generally performed at or near the installer's eye level, or over the installer's head, with the installer oriented facing the interior of the vehicle from the rear in this specific application. Thus, what is needed in the art is a tool that can be used to perform this rotating and pressing process—holding the recessed handle structure, providing required rotational leverage, and applying required linear pressure to the locking tabs of the recessed handle structure as it is being installed into the interior or bottom surface of the trunk door.

BRIEF SUMMARY OF THE DISCLOSURE

In various aspects, the present disclosure provides a tool for holding a recessed handle structure to be installed into a hole manufactured into the interior or bottom surface of a trunk door, providing required rotational leverage, and applying required linear pressure to locking tabs of the recessed handle structure as it is being installed into the interior or bottom surface of the trunk door, thereby securing the recessed handle structure within the hole manufactured into the interior or bottom surface of the trunk door. The use of this tool effectively saves time and protects the installer's fingers and the like.

In one aspect, the present disclosure provides a recessed structure installation tool configured for installing a recessed structure in a surface of a vehicle, the recessed structure installation tool including: a head member configured to at least partially conformally engage the recessed structure; an elongate member coupled to the head member, wherein the elongate member includes an axial portion and an off-axis portion disposed at an angle relative to the axial portion; and a handle member coupled to the elongate member opposite the head member; wherein the handle member, the elongate member, and the head member are collectively configured to apply one or more of a rotational force to the recessed structure and a linear force to locking tabs of the recessed structure when the handle member is one or more of translated and pushed by a user when the head member is engaged with the recessed structure, thereby securing the recessed structure to the surface of the vehicle. The head member includes one or more of a prismatic portion and a tapering portion. The off-axis portion of the elongate member is disposed at an angle of between about 15 degrees and about 75 degrees relative to the axial portion of the elongate member. Optionally, two or more of the head member, the elongate member, and the handle member are integrally formed. Optionally, one or more of the head member, the elongate member, and the handle member include one or more of a protective coating and a protective covering disposed on or about an exterior surface thereof. Optionally, the recessed structure includes a recessed handle structure. Optionally, the recessed handle structure is configured to be installed in an interior surface of the vehicle. Optionally, the recessed handle structure is configured to be installed in an interior trunk door surface of the vehicle while the trunk door is opened.

In another aspect, the present disclosure provides a method for installing a recessed structure in a surface of a vehicle, the method including: providing a recessed structure installation tool, including: a head member configured to at least partially conformally engage the recessed structure; an elongate member coupled to the head member, wherein the elongate member includes an axial portion and an off-axis portion disposed at an angle relative to the axial portion; and a handle member coupled to the elongate member opposite the head member; engaging the head member of the recessed structure installation tool with the recessed structure; and one or more of translating and pushing the handle member of the recessed structure installation tool such that the handle member, the elongate member, and the head member collectively apply one or more of a rotational force to the recessed structure and a linear force to locking tabs of the recessed structure, thereby securing the recessed structure to the surface of the vehicle. The head member includes one or more of a prismatic portion and a tapering portion. The off-axis portion of the elongate member is disposed at an angle of between about 15 degrees and about 75 degrees relative to the axial portion of the elongate member. Optionally, two or more of the head member, the elongate member, and the handle member are integrally formed. Optionally, one or more of the head member, the elongate member, and the handle member include one or more of a protective coating and a protective covering disposed on or about an exterior surface thereof. Optionally, the recessed structure includes a recessed handle structure. Optionally, the recessed handle structure is configured to be installed in an interior surface of the vehicle. Optionally, the recessed handle structure is configured to be installed in an interior trunk door surface of the vehicle while the trunk door is opened.

BRIEF DESCRIPTION OF THE DRAWINGS

The present disclosure is illustrated and described herein with reference to the various drawings, in which like reference numbers are used to denote like tool components/method steps, and in which.

DETAILED DESCRIPTION OF THE DISCLOSURE

Figure 1A:
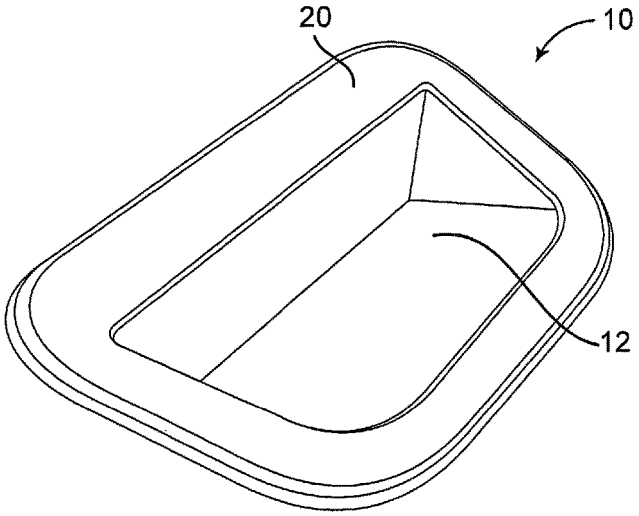
FIGS. 1*a*, 1*b*, and 1*c* are top, bottom, and side perspective views, respectively, of one exemplary recessed handle structure used in conjunction with the trunk handle installation tool of the present disclosure.
Figure 1B:
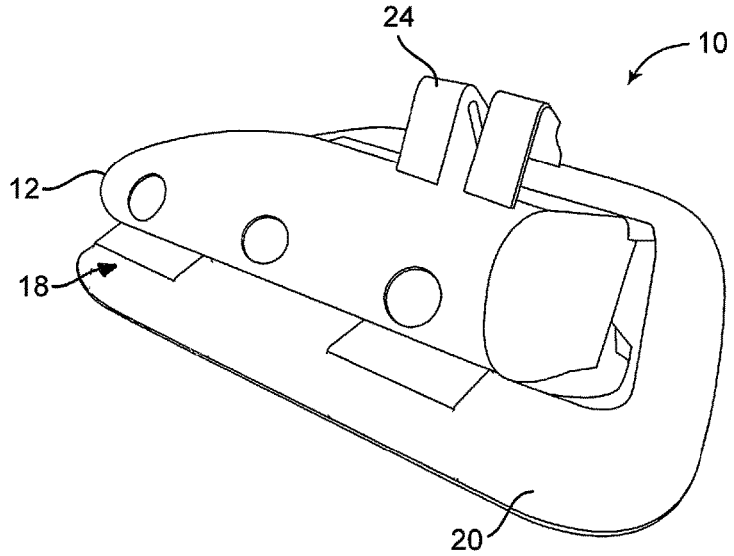
Figure 1C:
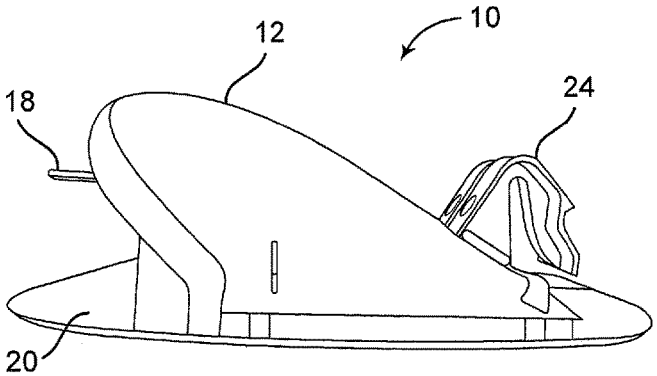

Referring now specifically to FIGS. 1*a*, 1*b*, and 1*c*, one exemplary recessed handle structure 10 used in conjunction with the trunk handle installation tool 100 (FIGS. 2-4) of the present disclosure is illustrated. It will be readily apparent to persons of ordinary skill in the art that the trunk handle installation tool 100 can be used with other similar recessed handle structures equally, as well as with other comparable recessed structures that are installed in a vehicle in a similar manner. The recessed handle structure 10 has a shape that generally conforms to a user's hand or fingers, forming a cup-like structure. Specifically, the recessed handle structure 10 includes a recessed grasping structure 12 forming a central portion thereof. The recessed handle structure 10 makes it easier for the user to grasp and hold, push, or pull the trunk door 14 (FIG. 4) as it is being opened or closed manually. The components of the recessed handle structure 10 can be made of any suitable rigid or semi-rigid plastic, polymeric, or metallic material by any suitable molding or forming process, well known to persons of ordinary skill in the art for forming the components of a vehicle. During manufacture, the recessed handle structure 10 is usually installed into the interior or bottom surface 16 (FIG. 4) of the trunk door 14 with the trunk door 14 in a partially or fully open configuration. The recessed handle structure 10 has a front or bottom side that includes one or more tab structures 18 that are disposed beneath the interior or bottom surface 16 of the trunk door 14, such that the front or bottom side of a lip structure 20 disposed around the user-facing side of the recessed handle structure 10, and around the recessed grasping structure 12, sits substantially in contact and flush with the interior or bottom surface 16 of the trunk door 14. The hand or finger-receiving portion of the recessed handle structure 10, i.e., the recessed grasping structure 12, sits within a hole 22 (FIG. 4) manufactured into the interior or bottom surface 16 of the trunk door 14. The recessed handle structure 10 is then rotated and pressed into position, such that locking tabs 24 disposed on the rear or top side of the recessed handle structure 10 are compressed into the hole 22 manufactured into the interior or bottom surface 16 of the trunk door 14 and snap back beneath the interior or bottom surface 16 of the trunk door 14, thereby securing the recessed handle structure 10 within the hole 22 manufactured into the interior or bottom surface 16 of the trunk door 14. In this position, the entire lip structure 20 disposed around the user-facing side of the recessed handle structure 10 sits substantially in contact and flush with the interior or bottom surface 16 of the trunk door 14.

Again, this rotating and pressing process is typically performed manually by the installer, using only his or her fingers and hands, which can be time consuming, difficult, and cause injury to the installer's fingers and hands. The process is generally performed at or near the installer's eye level, or over the installer's head, with the installer oriented facing the interior of the vehicle from the rear in this specific application.

Figure 2:
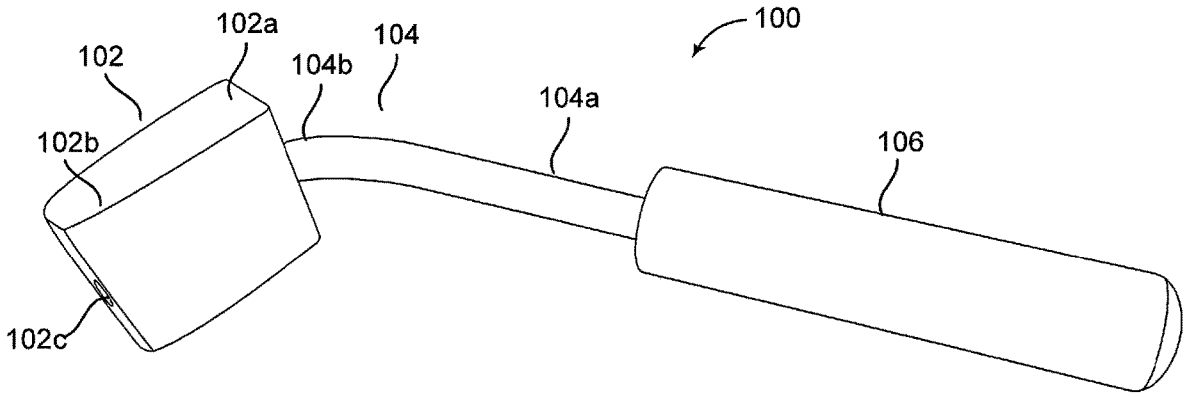
FIG. 2 is a perspective view of one exemplary trunk handle installation tool of the present disclosure.

Thus, referring now specifically to FIG. 2, one exemplary trunk handle installation tool 100 includes a head member 102 that is shaped and sized to be selectively disposed within the recessed grasping structure 12 (FIGS. 1*a*, 1*b*, and 1*c*) of the recessed handle structure 10 (FIGS. 1*a*, 1*b*, and 1*c*). Preferably, the head member 102 and the recessed grasping structure 12 fit together in a partially or substantially conformal manner. Accordingly, the head member 102 can include a prismatic (e.g., rectangular or oval-shaped) portion 102*a* and a tapering portion 102*b* that terminates in an end surface 102*c*, although other suitable configurations can be used equally. The tapering portion 102*b* can have tapers in one or multiple planes, as dictated by the recessed grasping structure 12 at issue. The head member 102 can be made of any suitable rigid or semi-rigid plastic, polymeric, metallic, or wood material by any suitable molding or forming process, well known to persons of ordinary skill in the art. The head member 102 is coupled to an elongate member 104 that includes an axial portion 104*a* and an off-axis portion 104*b* that is disposed at an angle to the axial portion 104*a*. Preferably, this angle is between about 15 degrees and about 75 degrees. Both the axial portion 104*a* and the off-axis portion 104*b* of the elongate member 104 can have a substantially circular, oval-shaped, square, rectangular, triangular, etc. cross-sectional shape. The elongate member 104 can be made of any suitable rigid or semi-rigid plastic, polymeric, or metallic material by any suitable molding or forming process, well known to persons of ordinary skill in the art. Preferably, the elongate member 104 has sufficient rigidity such that it can impart adequate longitudinal, lateral, and/or rotational forces to the head member 102 and the recessed grasping structure 12 in the installation of the recessed handle structure 10. The elongate member 104 is coupled to a handle member 106 opposite the head member 102. The handle member 106 can have a substantially circular, oval-shaped, square, rectangular, triangular, etc. cross-sectional shape and can include any number of grasping finger recesses, friction structures, and/or the like. It should be noted that all components of the trunk handle installation tool 10 can be fixedly or rotatably coupled together, or they may be integrally formed. For example, the handle member 106 can be disposed concentrically about a portion of the axial portion 104*a* of the elongate member 104. The handle member 106 can be made of any suitable rigid or semi-rigid plastic, polymeric, metallic, or wood material by any suitable molding or forming process, well known to persons of ordinary skill in the art. Preferably, the handle member 106 has sufficient rigidity such that it can impart adequate longitudinal, lateral, and/or rotational forces to the elongate member 104 and the head member 102 and the recessed grasping structure 12 in the installation of the recessed handle structure 10. Optionally, the elongate member 104 and the handle member 106 consist of different parts of the same general component. Advantageously, the bend of the trunk handle installation tool 100 allows the user to apply adequate leverage to the recessed handle structure 10 in a comfortable working position without coming into contact with and getting interference from the surrounding vehicle structures.

Figure 3:
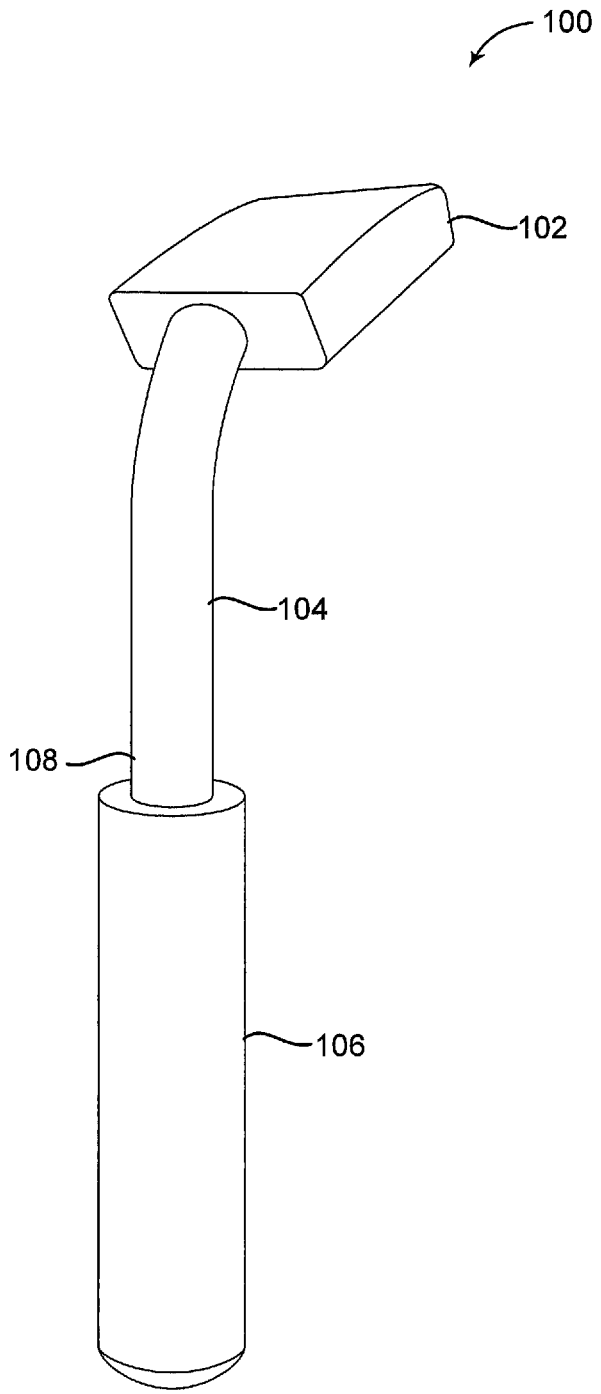
FIG. 3 is a perspective view of another exemplary trunk handle installation tool of the present disclosure, including a protective coating or covering disposed on or about all or a portion of the exterior surface of the trunk handle installation tool.

FIG. 3 illustrates a trunk handle installation tool 100 including a protective coating or covering 108 disposed on or about all or a portion of the exterior surface of the trunk handle installation tool 100. This protective coating or covering 108 can include a rubber or fabric material or the like that prevents the trunk handle installation tool 100 from scratching or otherwise damaging exterior and interior surfaces of the vehicle, etc., during the installation of the recessed handle structure 10 (FIGS. 1*a*, 1*b*, and 1*c*).

Figure 4:
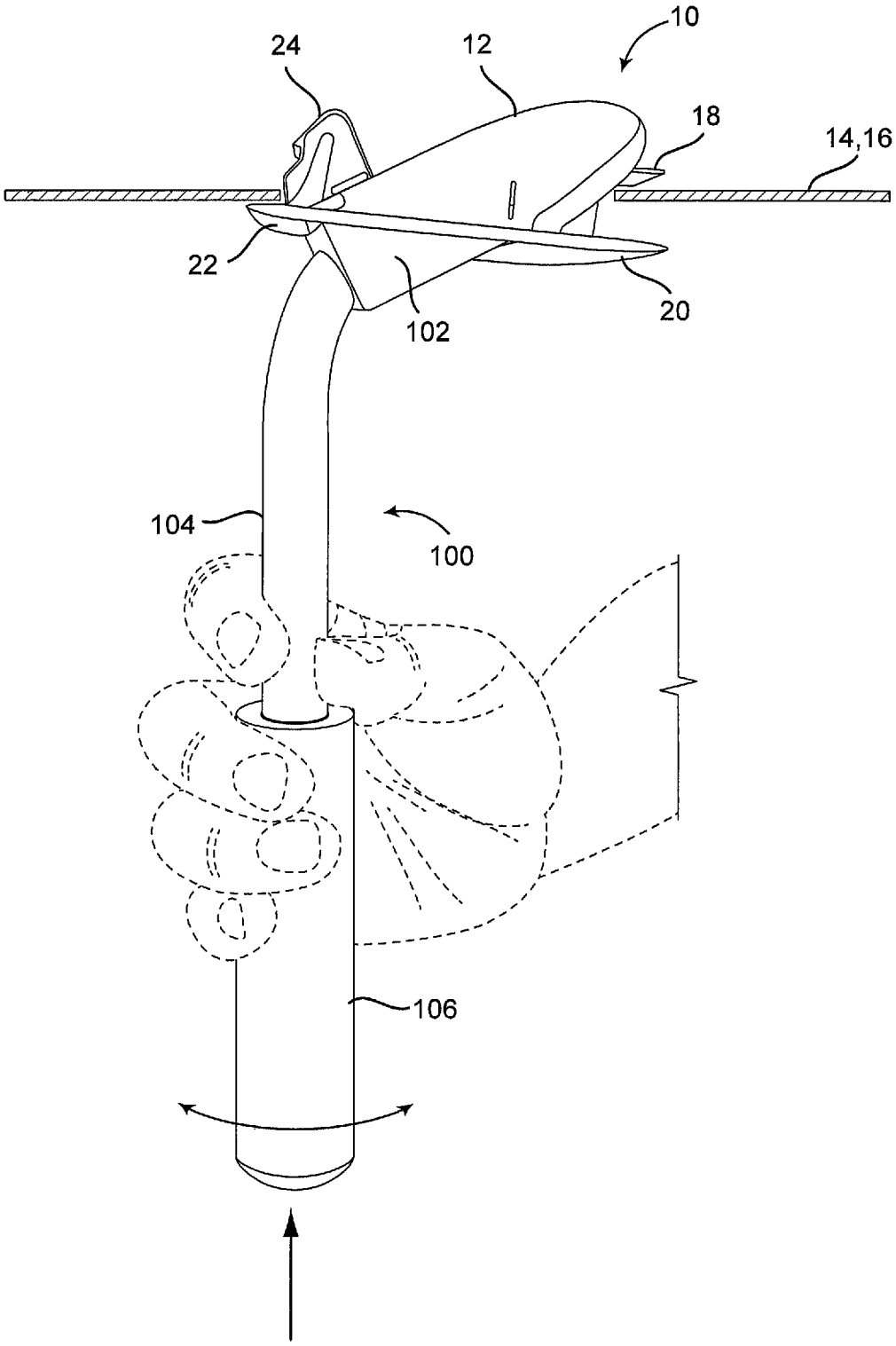
FIG. 4 is a perspective view illustrating the installation of a recessed handle structure into the interior or bottom surface of the trunk door of a vehicle using the trunk handle installation tool of the present invention.

FIG. 4 is a perspective view illustrating the installation of a recessed handle structure 10 into the interior or bottom surface 16 of the trunk door 14 of a vehicle using the trunk handle installation tool 100. The recessed handle structure 10 is installed into the interior or bottom surface 16 of the trunk door 14 with the trunk door 14 in a partially or fully open configuration. Again, the recessed handle structure 10 has a front or bottom side that includes one or more tab structures 18 that are disposed beneath the interior or bottom surface 16 of the trunk door 14, such that the front or bottom side of the lip structure 20 disposed around the user-facing side of the recessed handle structure 10, and around the recessed grasping structure 12, sits substantially in contact and flush with the interior or bottom surface 16 of the trunk door 14. The hand or finger-receiving portion of the recessed handle structure 10, i.e., the recessed grasping structure 12, sits within the hole 22 manufactured into the interior or bottom surface 16 of the trunk door 14. The head member 102 of the trunk handle installation tool 100 is inserted into the recessed grasping structure 12. The recessed handle structure 10 is then rotated and pressed into position using the trunk handle installation tool 100, which is grasped by the handle member 106, such that the locking tabs 24 disposed on the rear or top side of the recessed handle structure 10 are compressed into the hole 22 manufactured into the interior or bottom surface 16 of the trunk door 14 and snap back beneath the interior or bottom surface 16 of the trunk door 14, thereby securing the recessed handle structure 10 within the hole 22 manufactured into the interior or bottom surface 16 of the trunk door 14. In this position, the entire lip structure 20 disposed around the user-facing side of the recessed handle structure 10 sits substantially in contact and flush with the interior or bottom surface 16 of the trunk door 14.

Advantageously, the trunk handle installation tool 100 of the present disclosure allows a user to impart proper rotational force to the recessed grasping structure 12 and linear force to the locking tabs 24 of the recessed handle structure 10 such that the recessed handle structure is snapped into place in the interior or bottom surface 16 of the trunk door 14 of a vehicle. By design, this can be accomplished from a safe and comfortable user position, with a minimum of user time and effort—in part due to the tool angle utilized.

Although the present disclosure is illustrated and described herein with reference to aspects and examples thereof, it will be readily apparent to persons of ordinary skill in the art that other aspects and examples may perform similar functions and/or achieve like results. All such equivalent aspects and examples are within the spirit and scope of the present disclosure, are contemplated thereby, and are intended to be covered by the following non-limiting claims for all purposes.

What is claimed is:

1. A system, comprising:

a recessed structure installation tool configured for installing a recessed structure in a surface of a vehicle, the recessed structure installation tool comprising:

a head member configured to at least partially conformally engage the recessed structure;

an elongate member coupled to the head member, wherein the elongate member comprises an axial portion and an off-axis portion disposed at an angle relative to the axial portion; and a handle member coupled to the elongate member opposite the head member;

wherein the handle member, the elongate member, and the head member are collectively configured to apply a rotational force to the recessed structure and a linear force to locking tabs of the recessed structure when the handle member is translated and pushed by a user when the head member is engaged with the recessed structure, thereby securing the recessed structure to the surface of the vehicle;

wherein the recessed structure comprises a recessed handle structure configured to be installed in an interior surface of a trunk door of the vehicle while the trunk door is opened; and wherein the off-axis portion of the elongate member is disposed at an angle relative to the axial portion of the elongate member that is selected such that the rotational force applied to the recessed structure provides a linear force applied to the locking tabs of the recessed structure that is sufficient to engage the locking tabs of the recessed structure with the interior surface of the trunk door.

2. The system of claim 1, wherein the head member comprises a prismatic portion.

3. The system of claim 1, wherein the off-axis portion of the elongate member is disposed at an angle of between about 15 degrees and about 75 degrees relative to the axial portion of the elongate member.

4. The system of claim 1, wherein two or more of the head member, the elongate member, and the handle member are integrally formed.

5. The system of claim 1, wherein the head member comprises a protective covering disposed on or about an exterior surface thereof.

6. The system of claim 1, wherein the head member comprises a tapering portion.

7. The system of claim 1, wherein the elongate member comprises a protective covering disposed on or about an exterior surface thereof.

8. The system of claim 7, wherein the protective covering comprises a protective coating.

9. The system of claim 1, wherein the handle member comprises a protective covering disposed on or about an exterior surface thereof.

10. The system of claim 9, wherein the protective covering comprises a protective coating.

11. A method for installing a recessed structure in a surface of a vehicle, the method comprising:

providing a recessed structure installation tool, comprising:

a head member configured to at least partially conformally engage the recessed structure;

an elongate member coupled to the head member, wherein the elongate member comprises an axial portion and an off-axis portion disposed at an angle relative to the axial portion; and a handle member coupled to the elongate member opposite the head member;

engaging the head member of the recessed structure installation tool with the recessed structure; and translating and pushing the handle member of the recessed structure installation tool such that the handle member, the elongate member, and the head member collectively apply a rotational force to the recessed structure and a linear force to locking tabs of the recessed structure, thereby securing the recessed structure to the surface of the vehicle;

wherein the recessed structure comprises a recessed handle structure configured to be installed in an interior surface of a trunk door of the vehicle while the trunk door is opened.

12. The method of claim 11, wherein the head member comprises a prismatic portion.

13. The method of claim 11, wherein the off-axis portion of the elongate member is disposed at an angle of between about 15 degrees and about 75 degrees relative to the axial portion of the elongate member.

14. The method of claim 11, wherein two or more of the head member, the elongate member, and the handle member are integrally formed.

15. The method of claim 11, wherein the head member comprises a protective covering disposed on or about an exterior surface thereof.

16. The method of claim 11, wherein the head member comprises a tapering portion.

17. The method of claim 11, wherein the elongate member comprises a protective covering disposed on or about an exterior surface thereof.

18. The method of claim 17, wherein the protective covering comprises a protective coating.

19. The method of claim 11, wherein the handle member comprises a protective covering disposed on or about an exterior surface thereof.

20. The method of claim 19, wherein the protective covering comprises a protective coating.

* * * * *